US006939099B1

(12) United States Patent
Stokkeland

(10) Patent No.: US 6,939,099 B1
(45) **Date of Patent: *Sep. 6, 2005**

(54) HOOK ATTACHMENT DEVICE

(76) Inventor: Curtis Stokkeland, P.O. Box 647, Cooperstown, ND (US) 58425

( * ) Notice: This patent issued on a continued prosecution application filed under 37 CFR 1.53(d), and is subject to the twenty year patent term provisions of 35 U.S.C. 154 (a)(2).

Subject to any disclaimer, the term of this patent is extended or adjusted under 35 U.S.C. 154(b) by 0 days.

(21) Appl. No.: 09/927,696

(22) Filed: Aug. 10, 2001

(51) Int. Cl.[7] ..... B66C 1/00
(52) U.S. Cl. ..... 414/729; 414/723; 414/912; 414/918; 37/468; 37/406
(58) Field of Search ..... 414/607, 659, 414/660, 661, 729, 917, 913, 723, 724; 294/67.2, 294/67.22, 104, 3; 37/405, 406; 254/389; 248/65, 67.7, 73, 284.1; 212/253; 34/468

(56) References Cited

U.S. PATENT DOCUMENTS 3,776,403 A * 12/1973 Rillings ..... 414/918 X
4,598,882 A * 7/1986 Opdahl ..... 254/389 X
4,804,309 A * 2/1989 Risch ..... 414/723 X
4,969,795 A * 11/1990 Toyoda et al. ..... 414/918 X
5,232,330 A * 8/1993 Rae et al. ..... 414/918 X
5,518,359 A * 5/1996 Pratt ..... 414/724
5,564,885 A * 10/1996 Staben, Jr. ..... 414/724
6,168,369 B1 * 1/2001 Bright et al. ..... 414/724

* cited by examiner

*Primary Examiner*—Donald W. Underwood
(74) *Attorney, Agent, or Firm*—Robert E. Kleve

(57) ABSTRACT

The invention comprises a hook attachment having a frame with a plurality of hooks pivotally mounted to the frame. The attachment has a engaging flange and eyelets for receiving the attaching flange and engaging pins, respectively on the front of the arms of a front end loader. The attachment has an attaching flange and engaging pins mounted on the front of the frame of the attachment for engaging an attaching flange and eyelets on the rear of a bucket, whereby the hook attachment may be attached directly to the front of a front end loader and used alone with the front end loader, or the attaching flange and engaging pins on the front of the frame of the locking attachment may engage the attaching flange and eyelets on the rear of the bucket to attach the bucket to the flange of the hook attachment so that the hook attachment and bucket may be used together on the front end loader.

4 Claims, 6 Drawing Sheets

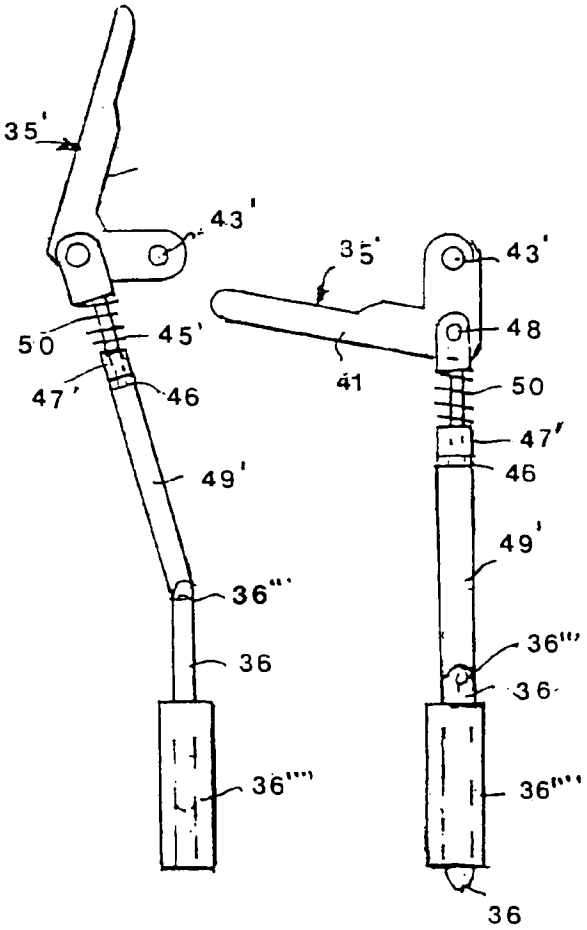
FIG.6
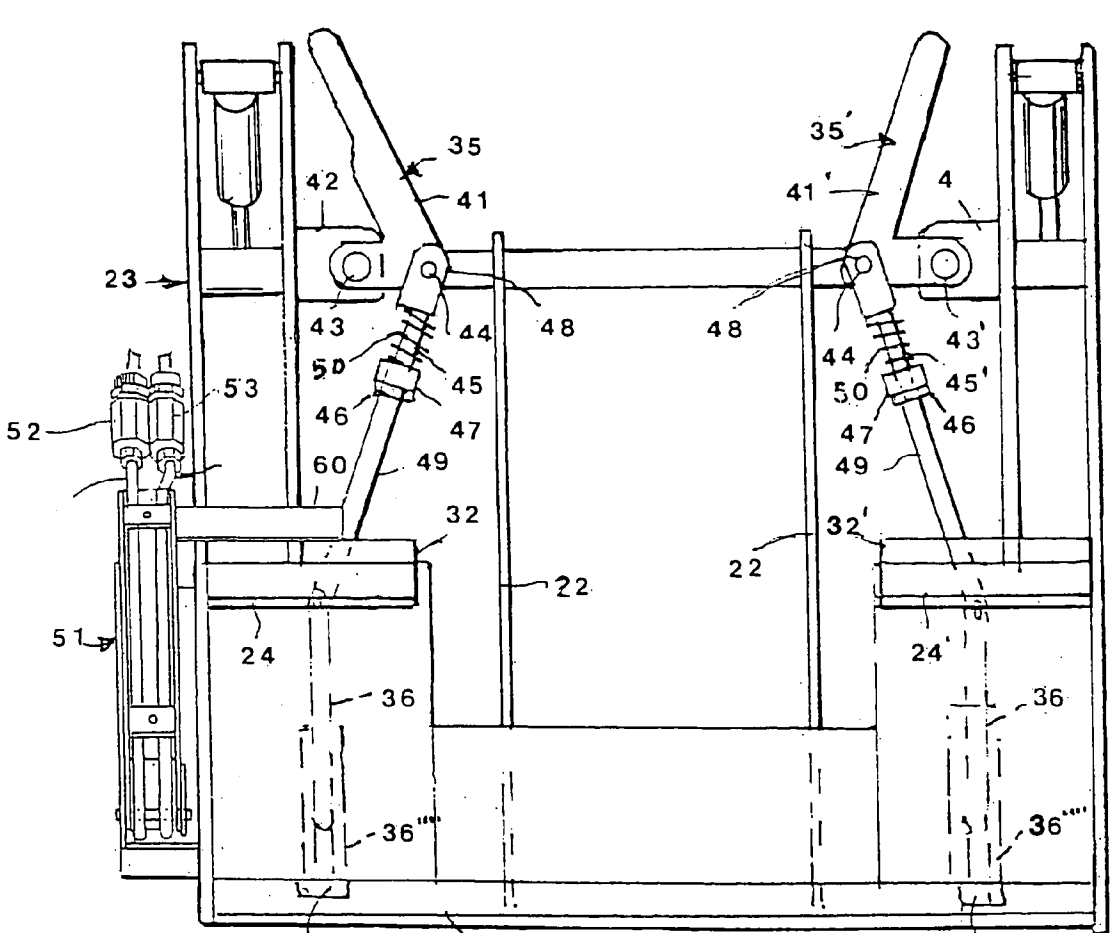
FIG.5
FIG.7

HOOK ATTACHMENT DEVICE

It is an object of the invention to provide a novel hooking attachment with power operated hooks and with a frame adapted to be detachably mounted to a front end loader and with the frame having means to detachable mount a bucket.

It is further object of the invention to provide a novel hook attachment for a front end loader.

It is another object of the invention to provide novel hydraulic cable mechanism for guiding the position of the cable as it is moved.

It is another object the invention to provide novel hydraulically powered hook attachment having a novel guide mechanism for the cables providing hydraulic power to the hook mechanism.

Further objects and advantages of the invention will become apparent as the description proceeds and when taken in conjunction with the accompanying drawings wherein:

BRIEF DESCRIPTION OF THE DRAWINGS

FIG. 5 is a rear elevational view of the frame of the hook invention.

FIG. 6 is a fragmentary view of one of the lever attachment mechanisms with the mechanism shown in its disengaged position.

FIG. 7 is a fragmentary view of one of the lever attachment mechanisms with the mechanism shown in its engaged position.

BRIEF DESCRIPTION OF PREFERRED EMBODIMENT

Briefly stated, the invention comprises hook or grapple apparatus attachment having a frame with a plurality of hooks pivotally mounted to the frame and with the frame adapted for attachment on its rear face to the a conventional attachment on the arms of a front end loader and with the frame having attachment means on its front face for attachment of a bucket thereto. The rear attachment on the frame includes apertures to receive the pills on the attachment on the loader and projecting flanges to receive the cooperating projecting attachment flanges on the front end loader to provide detachable attachment to a front end loader on its rear face whereby the hooks of the attachment may be attached to the front aims of a front end loader and the assembly include a pair of projecting flanges on its front face of the frame and movable pins on the front face which may in turn be detachable connected to the convention rear face of a bucket so as to enable the bucket to be selectively used in conjunction with the hooks of the attachment invention or the hooks may be used alone with the front end loader with the bucket detached from the hooks so that the loader is without the bucket on the front of the front end of a loader.

Figure 1:
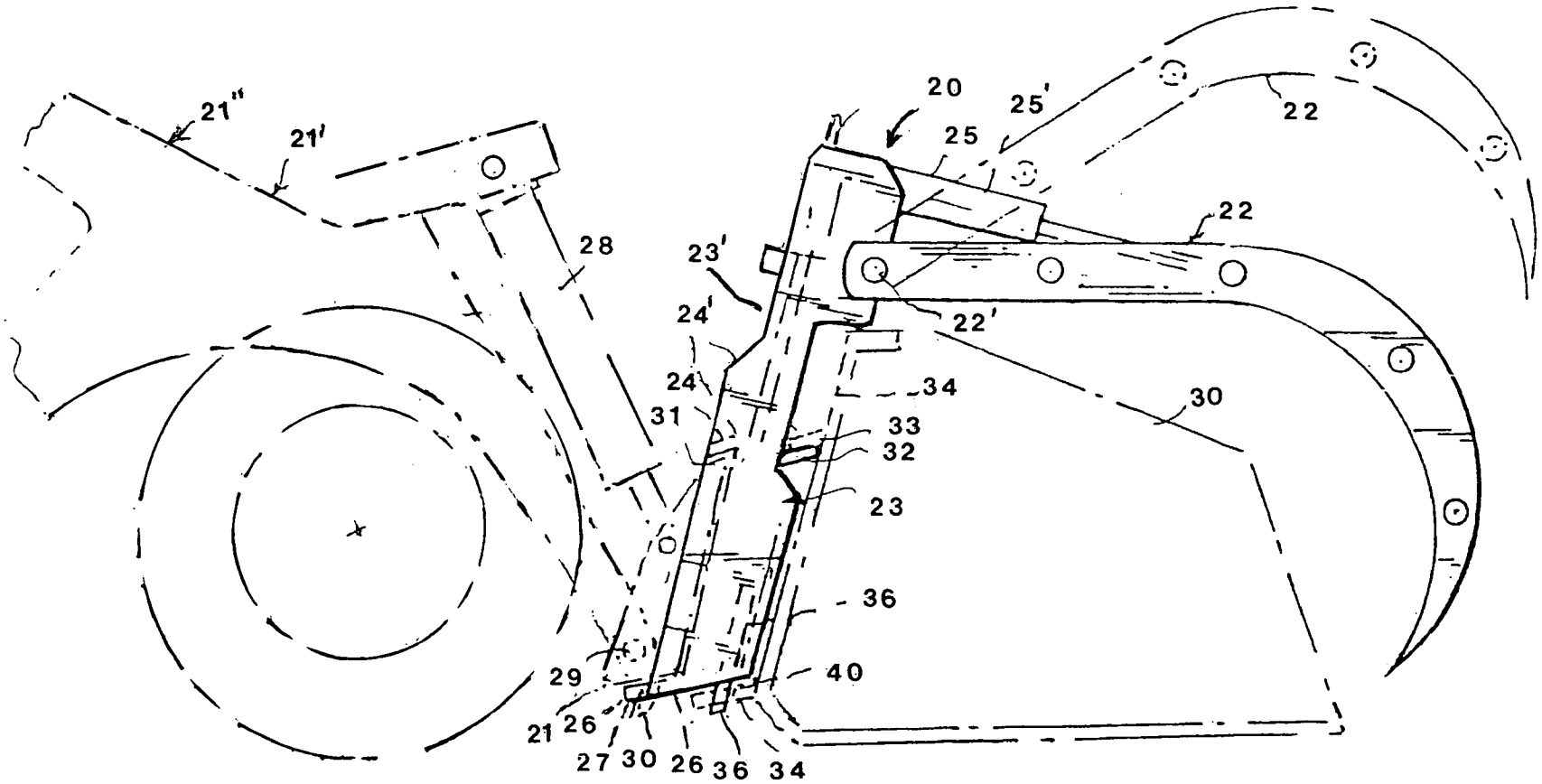
FIG. 1 is a right side elevational view of the hook attachment invention with the rear of the hook frame shown detachably attached to a front end loader with the loader shown in phantom lines, and the front of the hook frame shown detachably attached in turn to a bucket with the bucket shown in phantom lines.
Figure 2:
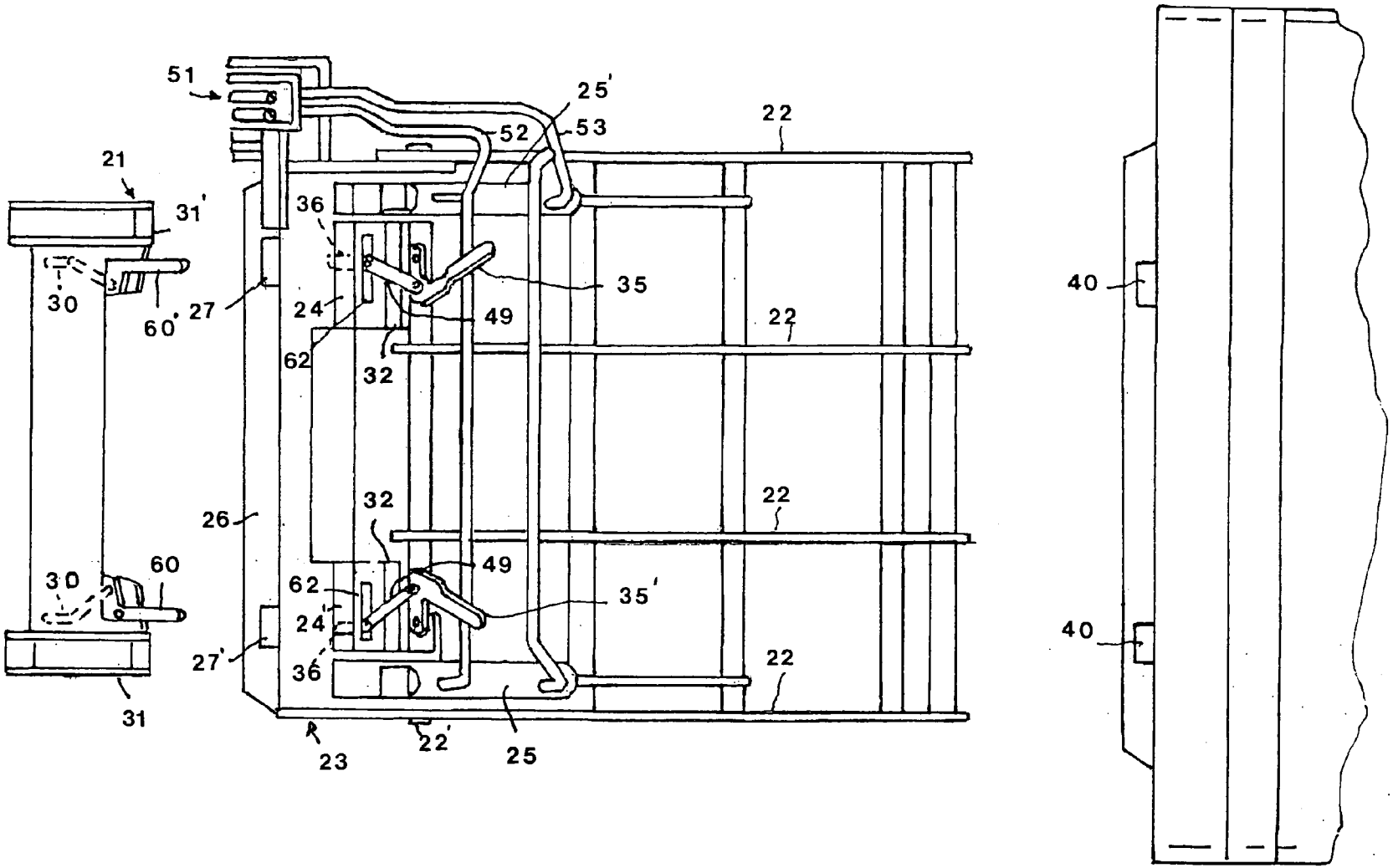
FIG. 2 is a top view of the hook attachment invention with the loader shown in phantom lines detached from the hook frame, and with the bucket shown detached from the hook attachment invention in phantom lines.
Figure 4:
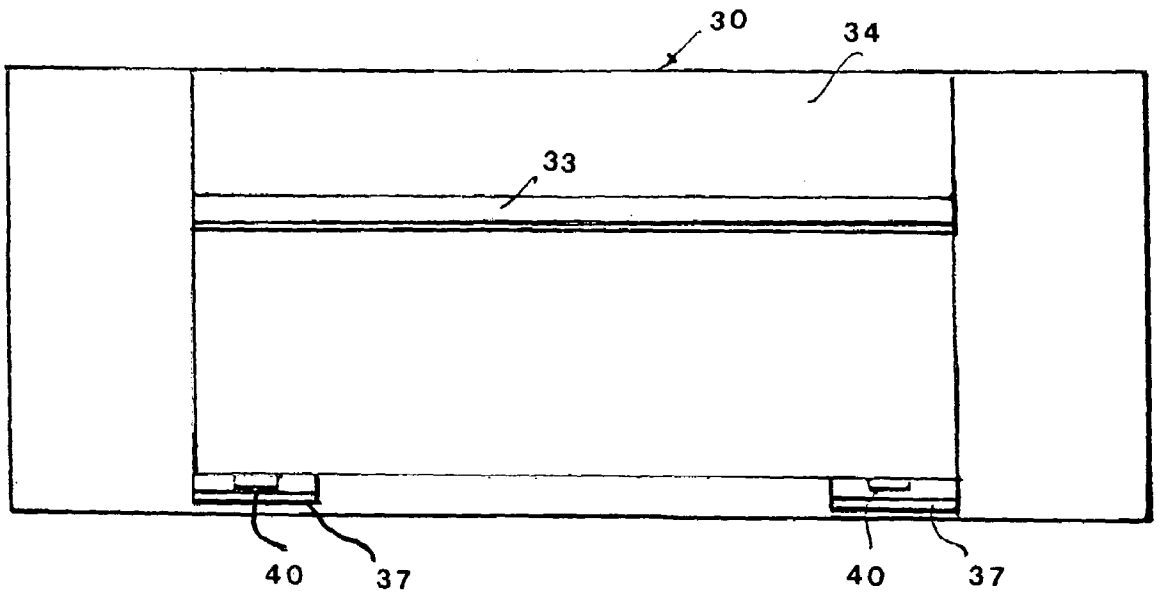
FIG. 4 is a rear view of the bucket taken along line 4—4 of FIG. 1.

Referring more particularly to the drawing, in FIG. 1, the hook and bucket assembly invention 20 is illustrated shown detachably connected to a conventional front attachment mechanism bracket 21 mounted on the outer ends of the arms 21' of a conventional front end loader 21". The hook and bucket assembly invention 20 has a plurality of hooks 22 and a hook frame 23 with the hooks pivotally mounted to the hook frame about a shaft 22'. The hook attachment invention has a pair of hydraulic piston and cylinders 25 and 25' pivotally mounted between the top of the frame 23 and the hooks 22 to pivot the hooks upward and downward on the frame 23 about the shaft 22'.

The hook frame 23 has a pair of projecting lugs or flanges 24 and 24' projecting angularly rearward and downward along its upper rear edge and a pair of rearward and downward projecting flange 26 along its lower rear edge with a pair of rod receiving holes 27 and 27' in the lower projecting flange 26.

The hook attachment invention 20 is adapted to be detachably mounted on the rear face 23' of the hook frame 23 to the conventional front end loader 21. The loader has pivotally mounted arms 28 and a conventional hydraulically operated lever attachment bracket 29 is pivotally mounted at pivot point 29 to the lower forward ends of the arms 21', powered by hydraulic pistons and cylinders 28. The hook frame 23 on its rear face 23" has a upper pair of downward projecting flanges 24 and 24' are adapted to detachably receive forward upward projecting flanges 31 and 31' on the top of the attachment bracket 21 on the front end loader. The holes 27 and 27' on the lower flange 26 of the hook frame are adapted to receive conventional lever manipulated pins 30 on the bracket 21 on the arms of the front end loader for mounting the hook frame 23 of the hook attachment invention 20 to the attachment bracket mechanism 21 of the front end loader.

The hook attachment invention 20 is also adapted to detachably mount a conventional bucket 30 to the front face 23" of its frame 23. A conventional bucket has a rear face 34 similar to the rear face of the hook frame 23 with a pair of rearward and downward projecting flanges 33 intermediate the height of the rear wall of the bucket and a pair of eyelets or holes 40 in flanges 37, which flanges project rearward and downward along the lower rear face 34 of the bucket.

The front face 23' of the frame 23 of the hook attachment invention 20 has a pair upward projecting flanges 32 and 32' on the upper front face of the frame 23 projecting angularly forward and upward. The flanges are adapted to be detachably engage beneath complementary rearward and downward angular projecting flange 33 on the rear face 34 of the bucket 30. The front hook attachment invention 20 has a pair of lever manipulated rod members 35 and 35' mounted to the forward portion of the frame 23 of the attachment invention with pins 36 and 36' directed downward.

The conventional bucket 30 has the pair of rearward projecting flanges 37 on its rearward lower portion 38' of the bucket frame 39 directed angularly rearward and downward with the holes 40 therein to receive the pins 36 and 36' of the hook attachment invention to detachably connect the bucket 30 to the hook attachment invention 20.

The manipulative lever members 35 and 35' of the hook frame 23 each have handles 41 and 41' which are pivotally mounted on pins 43 and 43', which pins are fixed to flanges 42, and the flanges are in turn fixed to the frame 23. The handles are pivotally mounted at a second pivot point by pins 44 to short rods 45 and 45'. The short rods 45 and 45' each have an enlarged head member 46 at their lower end and an enlarged head 48 at their upper end, and the rods 45 and 45' slide in sleeves 47 and 47', which sleeves are fixed to the upper ends of connecting rods 49 and 49'. The rods extend downward to the lower portion of frame 23. A coil spring 50 is fitted between each sleeve 47 and 47' of the connecting rods and the upper heads 48 on the short rods 45' and act to cushion upward movement of the connecting rod relative to the short rods 45 and 45' when the connecting rod sleeves 47 and 47' are urged upward on the rods 47 and 47', causing the sleeves of rods 49 and 49' to slide upward on the rods 45 and 45'. The coil springs act engage the upper ends of the sleeve and they act to cushion that upward movement and act to urge the connecting rods back down on the rods 45 and 45'. The pins 36 and 36' are pivotally mounted at their upper ends at pivots 36'" to the lower ends of the rods 49 and 49'. The pins are slidably mounted in sleeves 36"" fixed at the bottom of the frame 23.

Operation

The hook attachment invention operates as follows;

The front end loader 21' will be driven up to the hook attachment invention 20 and the arms 28 of the loader will be pivoted downward to lower the attachment bracket 21 near the ground slightly below its position as shown in FIG. 1, with the bracket 21 pivoted clockwise slightly further than shown in the drawing, to facilitate the attachment. Whereupon the loader 21 will be driven further forward until the upward projecting flanges 31 and 31' on the forward face of the attachment 21 of the loader are beneath the flanges 24 and 24' on the rear face 23" of the frame 23 of the hook attachment invention 20.

Whereupon the arms 28 of the loader will be raised a short distance on the loader to enable the flanges 31 to slide directly up under the flanges 24 and 24' of the hook attachment invention and the hook attachment 21 will then be pivoted back counterclockwise about its pivots 29 and 29' toward is position shown in FIG. 1 by the retraction of the pistons of the cylinders 21'", and the arms raised slightly further, if necessary, to cause the hook attachment to pivot about the flanges causing the lower flanges 26 and 26' to slide under the pins 30 of the attachment 21 of the front end loader, while flanges 24 and 24' remain hooked on the flanges 31 of the hook frame 23.

Figure 3:
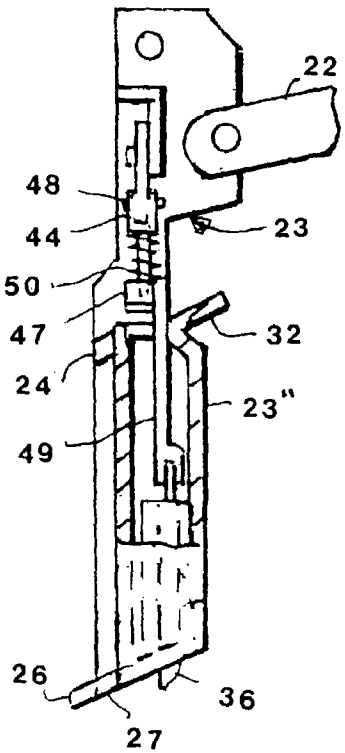
FIG. 3 is a cross sectional view of the hook frame taken along line 3—3 of FIG. 2.
Figure 8:
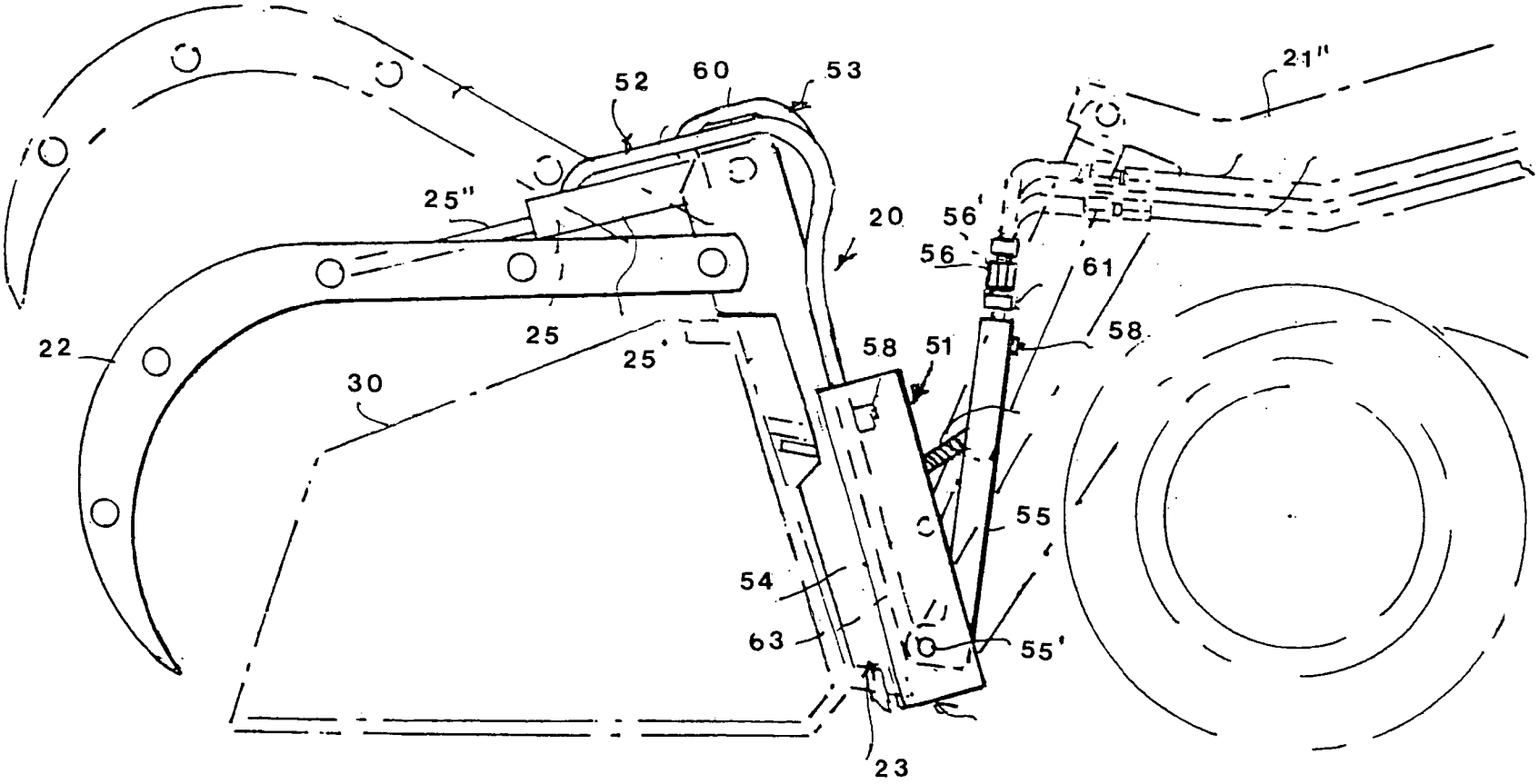
FIG. 8 is a left side elevational view of the hook attachment invention and illustrating the hydraulic cable guide mechanism attached to the side of the hook frame.
Figure 9:
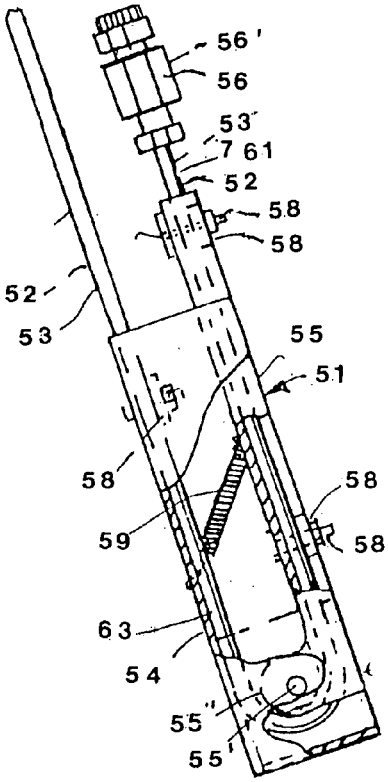
FIG. 9 is an enlarged side elevational view of the hydraulic cable guide mechanism.
Figure 10:
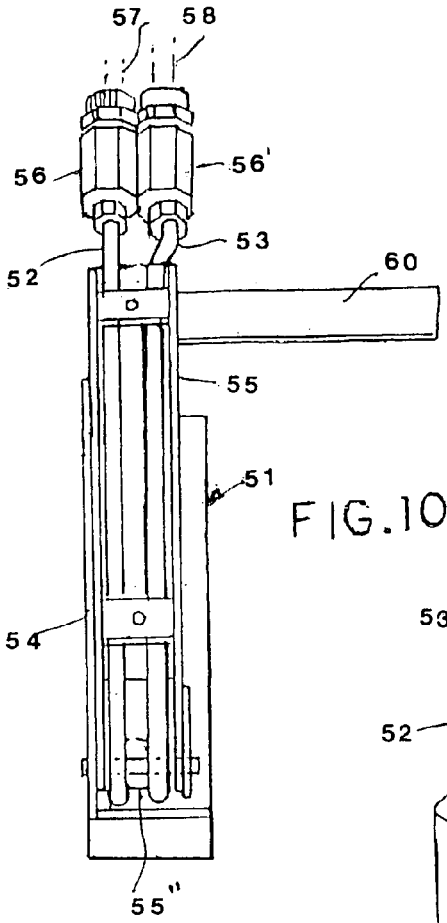
FIG. 10 is an enlarged front elevational view of the hydraulic cable guide mechanism.
Figure 11:
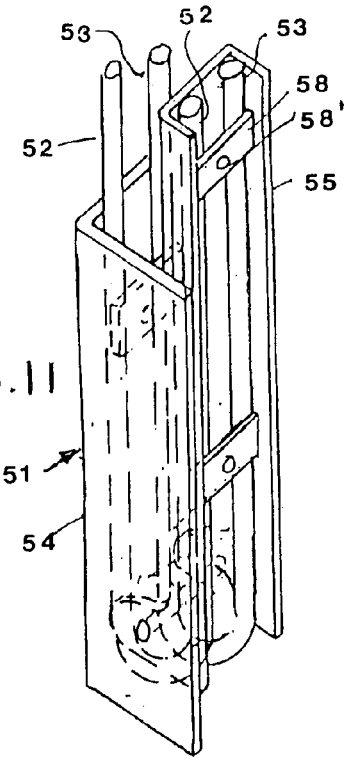
FIG. 11 is a perspective view of the hydraulic cable guide mechanism.

Whereupon the handles 60 and 60' of the attachment 21 on the arms 28 of the front end loader will be pivoted downward from their position shown in solid lines in FIG. 3 which will cause the connecting rods of the attachment 21 of the front end loader to slide downward and thereby cause the pins 30 mounted to the bottom of the connecting rods to slide downward in their sleeves at the bottom of the attachment flanges. The downward movement of the pins 30 will cause them to slide down into the holes 27 and 27' in the bottom flanges 31 and 31" of the rear attachment frame 23 of the hook attachment as shown in FIG. 1, thereby locking the frame 23 of the hook attachment as well as the hook attachment to the attachment bracket 21 of the front end loader, so that the frame 23 will move with the attachment bracket when the attachment bracket is moved by its hydraulic cylinders between the bracket and the arms and when the arms of the loader are moved upward downward by the hydraulic cylinders of the loader powering the arms.

Once the hook attachment 20 has been attached to the attachment 21 of the front end loader, the piston and cylinders 25 and 25' of the hook attachment invention will be connected to the hydraulic lines of the front end loader.

A hydraulic line guide mechanism 51 is provided to guide the hydraulic lines 52 and 53 between the hydraulic cylinders 25 and 35' and the hydraulic lines 57 and 58 which provide hydraulic fluid under pressure from a pump on the loader to the lines 52 and 53 to power the cylinders 25 and 25' in both directions. The hydraulic line guide mechanism has two elongated channels 54 and 55 pivotally connected together by a pivot 55' at the bottom of the channels. The channel 53 has one side fixed to the side of the frame 23 of the hook attachment invention 20.

The hydraulic lines 52 and 53 extend from the cylinders 25 and 25' through a line handling channels 54 and 55 of the hydraulic line guide mechanism or bracket 51 mounted on one side of the frame 23 and these lines terminate coupled to the couplings 56 and 56' of the hydraulic lines 57 and 58 of the loader.

These lines 57 and 58 on the loader are connected at their other ends to a pump, not shown, on the loader. The pump on the loader pumps hydraulic fluid along lines 57 and 58 and lines 52 and 53 to the hydraulic cylinders 25 and 25', with cylinder 25' being connected in parallel with cylinder 25 to provide hydraulic fluid under pressure to both cylinders to power the telescoping of the pistons 25" of cylinders 25 and 25' to pivot the hooks upward and downward about the pivots on the frame 23 to thereby raise and lower the hooks relative to the hook frame.

Once the hydraulic lines from the cylinders 25 and 25' of the hook attachment have been connected to the hydraulic pump of the front end loader, the hook attachment invention can be operated to hook or grapple objects with the hooks 22.

When it is desired to use the bucket 30 in combination with the hook attachment invention 20, the operator will move the front end loader with the hook attachment attached to the attachment bucket 30.

Whereupon, the operator of the front end loader will raise the arms of the front end loader to raise the attachment 21' of the loader and the hook attachment invention 20 off the ground and then move the loader and the hook attachment until they are in front of the bucket and then lower the arms of the front end loader to lower the attachment and the hook attachment to the ground and then move the loader, attachment and hook attachment forward until the frame of the hook attachment is in front and below the flanges of the bucket. Whereupon, the operator of the front end loader will raise the arms of the loader to raise the hook attachment to cause the flanges on the front of the frame of the hook attachment to engage under the flanges 33 of the bucket. Whereupon, the operator will if necessary also pivot the loader attachment member 21 counterclockwise when viewed from FIG. 1, to cause the lower front face of the frame 23 to pivot against the rear wall of the bucket thereby bringing the pins 36 over and in alignment above the holes 40 in the rear flange 37 of the bucket. The operator may then pivot the handles 41 and 41' downward from their positions as shown in FIG. 3 to cause the short rods and long rods 49 to slide downward in the frame 23 which cause the pins 36 and 36' downward in the sleeves of the frame and thereby engage in the holes 40 in the rear flange of the bucket thereby locking the bucket to the frame 23.

Thereupon, the bucket 30 will be locked to the frame 23 of the hook attachment and may be used with the hooks on the arms of the front end loader.

The pair of hydraulic lines 52 and 53 connect to the hydraulic cylinders and 25' at their forward ends 60 and at their rearward ends 61 are connected to hydraulic lines 57 and 58 on the front end loader. When the loader hydraulic cylinders 21"" are activated to pivot the loader attachment 21 about its axis 21' the pivoting action pivots the forward portions 60 relative to the rear ends 61 of the hydraulic lines or cables. The hydraulic cable mechanism 51 act as a elbow guide to guide the intermediate portions 63 of hydraulic lines 52 and 53 as they bend to accommodate the change in positions of their outer ends 60 and 61 relative to one another.

The hydraulic cable guide mechanism 51 is mounted to the one side 35 of the hook frame 23. The hydraulic cable guide mechanism has a pair of channel members 54 and 55. The channel member 54 is fixed to the side of the frame member 23. The channel member 55 is pivotally mounted by a pin 55' tp the channel member 54 at their bottoms with the channel member 55 adapted to pivot rearwardly away from the front channel member 54 about the pin 55'. A pulley 55" is rotatably mounted to the pin to guide the cable member 52 and 53 about their bend at the bottom of the channel members.

The channel members act to hold the outer portions of the cables in phase relative to one another as the bend or bow about the curved connection 56 between the channel members and prevent them from bending off to one side or the other and prevent loose cable sections from loosely moving about and to one side or the other when the hydraulic action of the cylinders pivoting the loader attachment relative to the loader arms causes these cables to bent in their intermediate portions. The hydraulic cable sections 52 and 53 extend from the hydraulic cylinders 25 and 25' into the channel member 54 and are held in place beside one another by the brackets 58 and the cable sections and then bow about the rod 55' pivotally connecting the channel members together.

The pair of hydraulic lines 52 and 53 connect to the hydraulic cylinders and 25' at their forward ends 60 and at their rearward ends 61 are connected to hydraulic lines 57 and 58 on the front end loader. When the loader hydraulic cylinders 28 are activated to pivot the loader attachment 21 about its axis 29 the pivoting action pivots the forward portions 60 relative to the rear ends 61 of the hydraulic lines or cables. The hydraulic cable mechanism 51 act as a elbow guide to guide the intermediate portions 63 of hydraulic lines 52 and 53 as they bend to accommodate the change in positions of their outer ends 60 and 61 relative to one another.

The hydraulic cable guide mechanism 51 is mounted to the one side 35 of the hook frame 23. The hydraulic cable guide mechanism has a pair of channel members 54 and 55. The channel member 54 is fixed to the side of the frame member 23. The channel member 55 is pivotally mounted by a pin 55' tp the channel member 54 at their bottoms with the channel member 55 adapted to pivot rearwardly away from the front channel member 54 about the pin 55'. A pulley 55" is rotatably mounted to the pin to guide the cable member 52 and 53 about their bend at the bottom of the channel members.

The channel members act to hold the outer portions of the cables in place relative to one another as the bend or bow about the curved connection 56 between the channel members and prevent them from bending off to one side or the other and prevent loose cable sections from loosely moving about and to one side or the other when the hydraulic action of the cylinders pivoting the loader attachment relative to the loader arms causes these cables to bent in their intermediate portions. The hydraulic cable sections 52 and 53 extend from the hydraulic cylinders 25 and 25' into the channel member 54 and are held in place beside one another by the brackets 58 and the cable sections and then bow about the rod 55' pivotally connecting the channel members together and then connecting cable portions run on upward along the other channel member 55 beside one another and are held in place by brackets 58' and ter inate with couplings 56' to the loader hydraulic lines 57 and 58.

The brackets 58 serve as brace members by engaging the cables at intervals along both channel members 54 and 55 and have bolts 58' with bolt heads which engage against the brace and are threaded into the channel members 54 and 55 to hold the brace against the cables and the cables in the channel members, while the cable members are allowed to pivot about the rod forming the pivotal connection between the channel members.

A coil spring 59 connects channel 54 to channel 55 to urge them together, and a strap 60 is fixed to channel 55 to engage the aim of the loader to prevent the channel 55 from pivoting too far apart from channel 54. The channel 55 will pivot away from channel 54 as the arms of the loader lift the hook attachment and the aim attachment is pivoted away from the arms by the hydraulic cylinders 28 which power the pivotal movement of the arm attachment on the arms of the loader.

Thus it will seen that a novel hook attachment has bee provided which enables the hook to be used alone with a front end loader or in combination with a bucket. It will be further seen that a novel hydraulic line guide mechanism has also been provided to guide and keep the hydraulic lines between the cylinders and the loader in a constant path as the lines are moved at their outer connecting ends to different spacings between the ends to keep the lines from loosely moving about and to one side or interfering in anyway during the operation of the hook attachment.

Slots 62 are provided in the lower portions of the frame 23 to allow the rods 49 and 49' to extend freely into the bottom of the frame and operate the pins 36.

It will be obvious that various changes and departures may be made to the invention without departing from the spirit and scope thereof, and accordingly, it is not intended that the invention be limited to that specifically described in the specification or as illustrated in the drawings but oily as set forth in the appended claims wherein:

What is claimed is:

1. A upstanding hook attachment device for attachment between a front end loader and bucket wherein said loader has arms which are powered by the loader to various positions with arm engagement means at the outer ends of the arms;

said upstanding hook attachment device comprising an elongated upstanding hook frame having an upper and lower end, a plurality of hooks each having downward pointed front ends and rearward portions pivotally mounted to the upper end of the hook frame, hydraulic means connected between the hooks and the hook frame to power the pivotal movement of the hooks relative to the hook frame, engagement means along the rearward portion of the hook frame to inter engage with the engagement means on the arms of the loader to lock the hook frame to the arms of the loader;

said bucket having an open front and a rearward face with engagement means on the rear face of the bucket;

said hook frame having inter engagement means on its front face to engage the engagement means on the rear face of the bucket to lock the bucket to the hook frame, while the hook frame, in turn, is locked to the arms of the loader, whereby the bucket may be used with the hooks on the hook frame while the hook frame and bucket are mounted to the arms of the loader; and wherein said bucket engagement means are engagable with the loader engagement means for directly mounting the bucket to the loader, in lieu of the hook frame;

said hydraulic means comprising hydraulic piston and cylinders mounted between the hooks and the hook frame to power the pivotal movement of the hooks on the hook frame, said hook frame having hydraulic cable lines extending from the loader to cylinders on the hook frame, said engagement means on said loader having a rigid detachable connection with said hook frame with a pivotal connection to the arms of the loader;

a pair of pivoting channels pivotal connected together at their ends with one of said channels mounted on the hook frame, said channels receiving said cable lines along their length with succeeding portions mounted to each channel with said cables having an intermediate portion between their channel portions adjacent the pivotal connection of the channels and adjacent the pivotal connection of the hook frame to the engagement means on the loader, whereby the channels and channel portions of the cable may pivot toward and away from on another when the engagement means on the loader pivots toward and away from the arms of the loader, said pivoting channels having a roller at its pivot connection for the intermediate portion of the cables to roll about thereon.

2. An elbow cable guide mechanism for guiding the movement of an intermediate portion of a elongated cable when outer opposing end portions of the cable are being moved toward and away from one another about the intermediate portion, said guide mechanism comprising a pair of elongated channels having remote ends pivotally connected together to place the channels in end to end relation along their length, said channels being adapted to receive the intermediate portion of the cable and retain one portion of the intermediate portion of the cable in one channel and a succeeding portion of the intermediate portion of the cable in the other channel with a connecting portion between the one portion and the succeeding portion extending about the pivotal connection of the channels to enable the intermediate portion of the cable to be guided in a definite pivoting movement pattern when the outer end portions of the cable move toward and away from one another, a roller rotatably mounted to the pivotal connection between the channels for the connecting portion of the intermediate portion of the cable to roll on when the channels and remote ends of the cable move toward and away from one another about the pivotal connection.

3. A hook attachment apparatus comprising an elongated upright rectangular hook frame having a plurality of hooks pivotally mounted thereon for use in connection with a front end loader or for use in connection with a front end loader and a bucket;

and wherein said front end loader has arms at its forward end with front attachment means at the front of the arms with said front attachment means comprising a forward pair of downward engaging attachment pins and a horizontal forward and upward projecting plate extending laterally across the front of the loader attachment means above the pair of downward engaging attachment pins;

and wherein said bucket has a pair of rear pin receiving eyelet attachment means on a rearward face portion of the bucket with a rearward and downward extending plate extending laterally across the rear face of the bucket;

said rectangular upright hook frame having an upper and lower end, said plurality of hooks having rearward ends pivotally mounted beside one another laterally parallel to one another along the upper end of the hook frame and extending forward with the forward ends forming forward and downward extending hooks;

said hook frame having a front and rear face;

a rear pair of eyelet pin receiving means on the lower rear face of the hook frame to detachably receive the front pair of pin attachment means on the arms of the loader, said hook frame having a rear complementary laterally and horizontally extending plate across the rear face of the hook frame projecting rearward and downward to frontally receive, in complementary relation, said horizontal front plate of said arms of said loader, to thereby detachably mount the hook frame to the front end loader, whereby the hook frame with the hooks may be used with the front end loader;

said hook frame having a horizontal and upward projecting plate on its front face to frontally and detachably engage beneath the horizontal rearward and downward extending plate on the rear face of the bucket, said hook frame having a front pair of downward engaging attachment pins on its front face to detachably engage the rear pin receiving eyelets on rear of the bucket to detachably mount the bucket to the front of the hook frame, whereby the hook frame and hooks thereon may be used alone on the front end loader with the bucket detached or the hook frame and hooks thereon may also be used with the front end loader with the bucket attached.

4. A hook frame according to claim 3, wherein the front pair of attachment pins each have a turnable handle to slidably and detachably engage the attachment pins to the bucket.

* * * * *